US005190227A

United States Patent [19]

Pallmann

[11] Patent Number: 5,190,227

[45] Date of Patent: Mar. 2, 1993

[54] BEATER MILL WITH INTEGRATED CENTRIFUGAL CLASSIFIER

[75] Inventor: Wilhelm Pallmann, Zweibrücken, Fed. Rep. of Germany

[73] Assignee: Pallmann Maschinenfabrik GmbH & Co. KG, Zweibruecken, Fed. Rep. of Germany

[21] Appl. No.: 822,143

[22] Filed: Jan. 17, 1992

[30] Foreign Application Priority Data

Jan. 18, 1991 [DE] Fed. Rep. of Germany ..... 4101343

[51] Int. Cl.[5] ..... B02C 13/10; B02C 23/08

[52] U.S. Cl. ..... 241/79.1; 241/188.1

[58] Field of Search ..... 241/79.1, 186.2, 186.3, 241/188.1, 191

[56] References Cited

U.S. PATENT DOCUMENTS

| | | | |
|---|---|---|---|
| 1,967,323 | 7/1934 | Pettibone | 241/188.1 X |
| 2,830,771 | 4/1958 | Pallmann | 241/186.2 |
| 3,173,618 | 3/1965 | Merges et al. | 241/188.1 X |
| 3,684,198 | 8/1972 | Pallmann | 241/73 |
| 3,731,883 | 5/1973 | Voelskow et al. | 241/52 |
| 3,917,175 | 11/1975 | Maeda et al. | 241/52 |

FOREIGN PATENT DOCUMENTS

| | | |
|---|---|---|
| 1507466 | 9/1966 | Fed. Rep. of Germany . |
| 3203324 | 2/1982 | Fed. Rep. of Germany . |

*Primary Examiner*—Frank T. Yost
*Assistant Examiner*—Clark F. Dexter
*Attorney, Agent, or Firm*—Foley & Lardner

[57] ABSTRACT

The invention relates to beater mills in the grinding chamber of which there rotates a beater rotor which is fitted on its circumference with beater tools and is surrounded by a cylindrical grinding surface adjoined by a coaxial centrifugal classifier. The centrifugal classifier is variably defined by retaining rings having different retaining rim heights, the rings bearing against the outlet-side end faces of the grinding surface so as to determine the classifying effects.

5 Claims, 1 Drawing Sheet

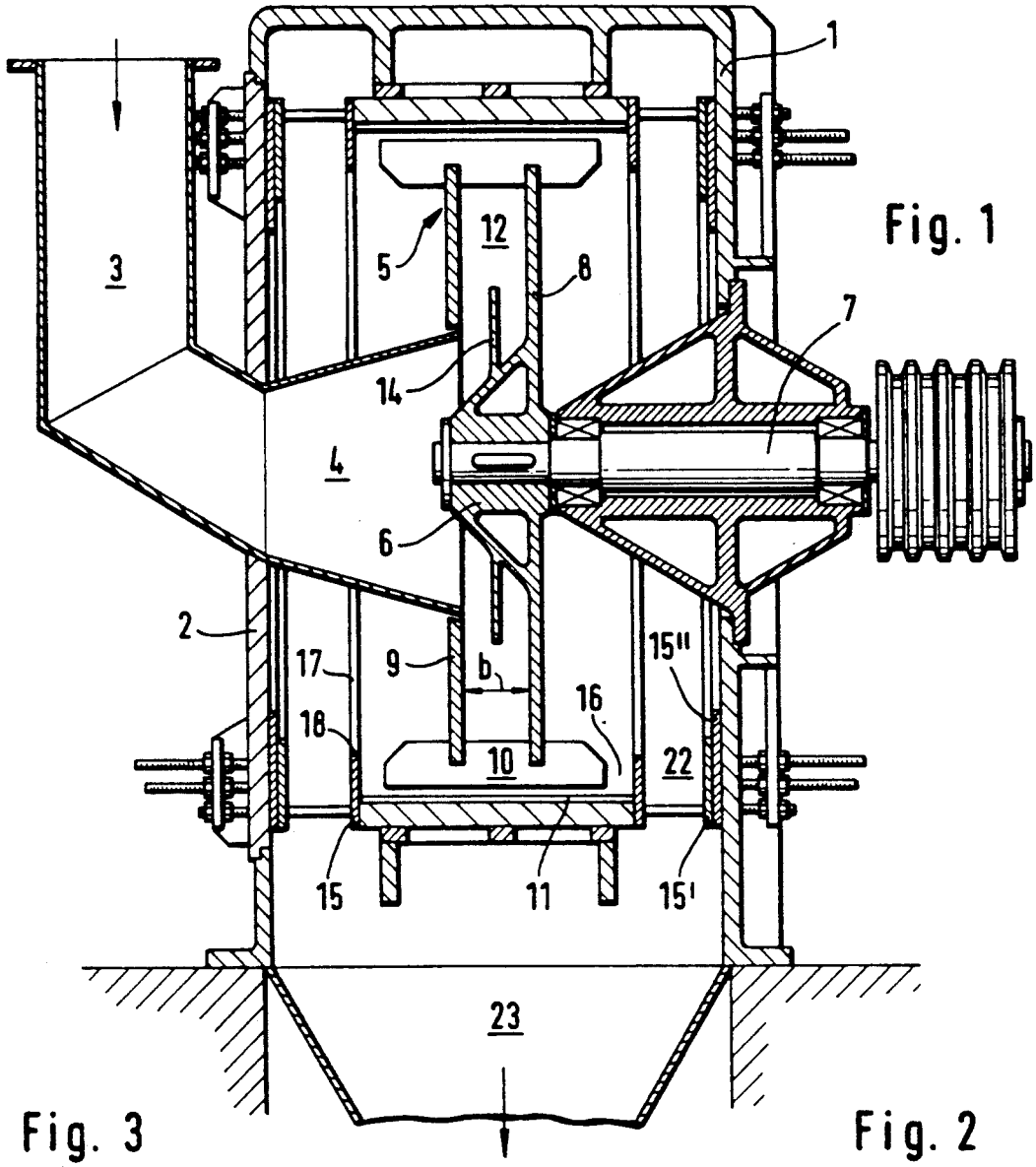
Fig. 1
Fig. 3
Fig. 2
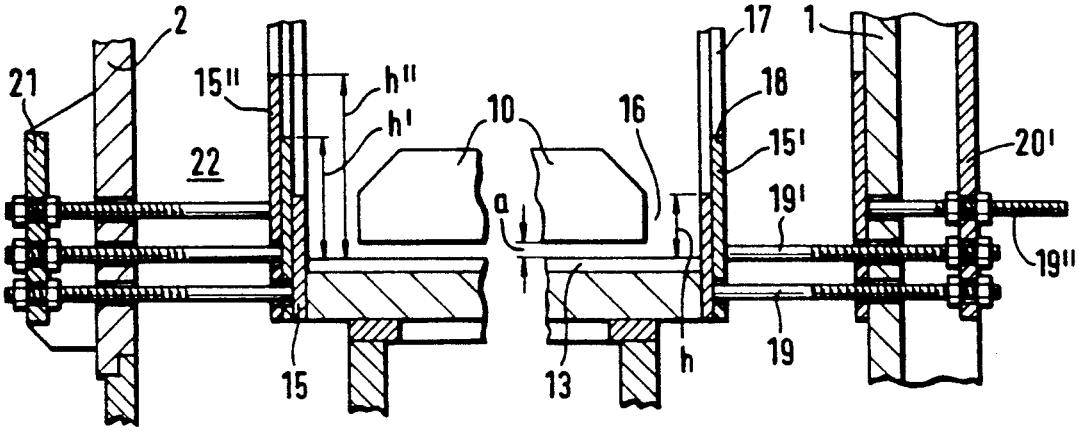

BEATER MILL WITH INTEGRATED CENTRIFUGAL CLASSIFIER

BACKGROUND OF THE INVENTION

The invention relates to a beater mill in the grinding chamber of which there rotates a beater rotor which is fitted on its circumference with beater tools and is surrounded by a cylindrical grinding surface adjoined by a coaxial centrifugal classifier. Such beater mills, also referred to as classifier mills, are known in numerous variations having the common feature that the grinding chamber and classifying chamber are mutually separated by a partition, with the oversize particles classified out in the classifying chamber by purposely influencing the classifying air flow being recirculated once again into the grinding chamber.

German Patent 2,444,657, for example, describes such a classifier mill, in which there is arranged between the grinding chamber and classifying chamber a stationary separating disk which forms with the cylindrical grinding surface an annular gap through which the mixture of ground material and air enters the classifying chamber. A spiral flow which produces the classifying effect is imparted there to the flow of ground material by adjustable guide vanes. The oversize particles classified out in this way is recirculated into the grinding chamber through openings that are provided in the separating disk.

German Patent 3,203,324 discloses a classifier mill which is simpler than this and in which only one solid circular disk, which can be adjusted in the axial direction and whose outer rim terminates in the radial direction in front of the beater plates of the beater rotor, is arranged in the region of the housing end wall on the outlet side. The large annular gap created in this way between the disk rim and the housing wall is intended to effect the recirculation into the grinding zone of the oversize particles leaving the grinding surface, it being the case that in the gap which is formed by said circular disk and the housing end wall on the outlet side, the width of which can be adjusted by axial displacement of the circular disk, the fine particles flow off to the central outlet nozzle, and this is additionally supported by stationary guide vanes.

However, as German Patent 1,507,466 shows, the partition between the grinding chamber and classifying chamber can also consist of a circular disk which rotates in common with the beater rotor and whose outer rim forms with the grinding surface an annular gap whose width can be adjusted in order purposely to influence the flow relationships in the classifying chamber.

As may be seen from German Patent 2,122,856, the partition between the grinding chamber and classifying chamber can also be formed by the rotor disk itself, which carries the beater plates and is consequently provided with openings for recirculating into the grinding zone of the oversize particles precipitated in the classifying chamber. The classifying effect is produced there by stationary guide vanes which cooperate with rotating classifier vanes.

It is therefore a common feature of all known classifier mills to recirculate once again into the grinding zone the oversize classified out in the classifying chamber, and this requires quite complicated structural measures, as the cited prior art demonstrates.

SUMMARY OF THE INVENTION

Consequently, it is the object of the invention to integrate the classifying process into the grinding process with a low structural outlay, that is to say not to discharge the material particles from the grinding zone until they have reached the desired degree of fineness.

According to the invention, this object is achieved when the centrifugal classifier is integrated into the grinding zone in such a way that at least one retaining ring whose retaining rim height determines the classifying effect bears against the outlet-side end face of the cylindrical grinding surface.

The retaining ring, which according to the invention is arranged on the outlet-side end face of the grinding surface, denies the flow of ground material moving on a helical path through the grinding gap free outlet from the grinding zone, the retaining ring imparting to said flow a spiral path of motion, which tends radially inwards and resembles an eddy sink whose initial velocity component in the circumferential direction is virtually equal to the circumferential velocity of the beater rotor. As is known for spiral air classifiers, a state of equilibrium is set up on this spiral path of motion between the centrifugal forces, which act on the material particles and are directed radially outwards towards the grinding surface, and the drag forces which tend radially inward toward the central retaining ring outlet. Since, as is known, the drag forces gradually exceed the centrifugal forces as communication progresses, that is to say with decreasing particle size, the spiral flow imparted by the retaining ring discharges from the grinding zone only those particles which have reached a sufficient degree of fineness which, naturally, becomes finer the longer the spiral flow acts on the material particles, that is to say the larger the retaining rim height of the retaining ring. Coarser particles are thus held in the region of the grinding surface until they have reached this degree of fineness. The retaining ring therefore represents, as it were, the outer axial boundary wall of a centrifugal classifier which is integrated into the grinding zone and in which a spiral classifying flow is set up automatically as consequence of the flow of the material to be ground arriving spirally at the retaining ring.

It is possible for a plurality of retaining rings with different retaining rim heights to be set optionally one after another on the outlet-side end wall of the grinding surface, as a result of which the degree of communication can be influenced in steps. In mills whose design parameters and operating parameters are carefully matched by means of tests to the ground material to be processed, this stepwise adjustability of the degree of communication is entirely sufficient in many cases, in particular where robustness of design, ease of replaceability, insensitivity to wear, and simple and cost-effective spares holding are of decisive economic importance.

It is also possible for the retaining rings not located in the operating position to be held in a position of readiness on the inside of the mill housing so that the degree of communication can also be influenced during operation. For this purpose, the retaining rings are additionally provided with control elements which can be actuated outside the mill housing.

In particular for the production of the retaining rings, it is favorable when they are constructed to be plane parallel with the radial plane perpendicular to the axis.

The invention can be particularly advantageously realized in twin-flow beater mills, such as described, for example, in German Patent 1,905,286.

BRIEF DESCRIPTION OF THE APPLICATION DRAWING

The invention is represented in more detail in the application drawing which illustrates, by way of example, a twin-flow beater mill and in which:

FIG. 1 is an axial cross-sectional view of a twin-flow beater mill equipped according to the invention; and FIGS. 2 and 3 show details on an enlarged scale in the region of the grinding surface.

DETAILED DESCRIPTION OF THE PREFERRED EMBODIMENTS

On its front end face, the mill housing 1 has a door 2 that can swivel out and in which an inlet port 3, which merges inside the mill housing 1 into a widening distributor cone 4, is provided for the material to be ground which is fed in an essentially pneumatic fashion.

Supported in a floating mount in the mill housing 1 on the rear housing wall is a beater rotor 5. It consists of a rotor hub 6 which is connected in a rotationally fixed manner to the drive shaft 7. Fixed to the rotor hub 6 is a hub plate 8 which is connected to an annular cover plate 9 by beater plates 10 arranged on the rotor circumference. The outer edges of the beater plates 10 cooperate with a stationary cylindrical grinding surface 11 which concentrically surrounds the beater rotor 5 with a grinding gap a (FIG. 2).

The hub plate 8 forms with the cover plate 9 a guide duct 12, shaped like an annular disk, which has an axial width b and in whose central region the distributor cone 4 opens into the beater rotor 5. In its peripheral region, the guide duct 12 opens out onto the axial center of the grinding surface 11, which is provided with strips or ribs 13 (FIG. 2) that are uniformly distributed over its circumference.

The conveyance of material in the guide duct 12 is additionally further supported by a distribution disk 14 connected to the rotor hub 6.

Bearing against each end face of the grinding surface 11 in each case is a retaining ring 15 which extends axially inwardly and which together form by means of their retaining rim height h (FIG. 3) the lateral, radially outer boundary walls of centrifugal classifiers 16 integrated into the grinding zone. The axially inner walls of the classifying chamber are defined by the plates 8 and 9. The central outlet openings 17 of the centrifugal classifiers are bound by the retaining rim 18 of the two retaining rings 15. Two further retaining rings 15' and 15" with larger retaining rim heights h' and h" are held in a position of readiness in each case on the inside of the end and rear housing walls. All the retaining rings 15, 15' and 15" are provided with a plurality of control elements 19, 19' and 19", respectively, distributed on the circumference, by means of which they can be adjusted in the axial direction from outside and can be locked both in their operating position and in their position of readiness on webs 20 and 21 located outside the mill housing 1.

FIG. 3 shows on an enlarged scale three retaining rings 15, 15' and 15" located in the operating position, and two retaining rings 15 and 15' are illustrated in the operating position in FIG. 2. In both instances, a greater fineness of material is achieved.

Located on both sides of the classifying chambers 16 are annular discharge chambers 22 which are spatially connected to the common ate 23.

The material to be ground is conveyed in inlet port 3 in a pneumatically supported fashion by the air flow produced by the beater rotor 5 into the mill housing 1 where the material passes through the distributor cone 4 into the central re beater rotor 5. There, it impinges on the distribution disk 14, which in addition to the pneumatically effected inflow speed, also further imparts mechanical motive impulses to the material particles and in this way supports the distributing function of the guide duct 12, which has the effect of uniformly loading the grinding surface 11 all round.

The beater plates 10 impart to the material to be ground on the grinding surface 11 a speed in the circumferential direction which, depending on the width a of the grinding gap, is somewhat lower than the circumferential speed of the beater rotor 5. The pneumatic transport of material in the axial direction is superimposed on this circumferential movement of the material to be ground, so as to produce a helical path of motion as a result. Consequently, starting from the axial center of the grinding surface 11, the mixture of the material to be ground and air moves on two oppositely directed helical paths to the two rim zones of the grinding surface 11, where it is denied free outlet from the grinding zone by the retaining rings 15 arranged on both sides of the grinding surface 11. Consequently, the helical path of motion of the mixture of the material to be ground and air merges here into a spiral path of motion tending radially inwards. As is known, material particles that are entrained by the air flow in such spiral paths are acted upon by centrifugal forces which tend to force them radially outwards, that is to say back once again onto the grinding surface. However, these centrifugal forces are opposed by drag forces which, for their part, tend to convey the particles radially inwards, that is to say to the outlet openings 17 formed by the retaining rim 18 of the retaining rings 15. The minimum fineness of material at which the material particles can leave the grinding zone is defined by the state of equilibrium set up on said spiral paths between the centrifugal forces on the one hand, and the drag forces on the other hand.

As illustrated in FIGS. 2 and 3, the degree of fineness of the material to be ground can be increased in steps by setting additional retaining rings 15' and 15" with larger retaining rim heights h' and h", respectively, on the grinding surface 11.

After passing the retaining rim 18 of the retaining rings 15, 15' and 15", the material particles flow off into the lateral annular chambers 22 of the mill housing 1, from where they pass into the common material outlet 23.

What is claimed is:

1. A beater mill with integrated centrifugal classifier comprising:

a beater mill housing, a beater rotor mounted for rotation in said housing, said beater rotor having beater tools mounted on the circumference thereof which are spaced from a cylindrical grinding surface having opposite end faces, a coaxial centrifugal classifier laterally outwardly of and spaced adjacent to said beater tools, and a plurality of pairs of retaining rings, one of said pairs bearing against said end faces of said grinding surfaces, each pair of retaining rings having different retaining rim heights, and means adjustably and selectively setting each of said pairs of rings adjacent said end faces, whereby said rings are adapted to be selectively positioned one after another on said end faces of the grinding surface so as to vary the classifying effect on material impinging on said grinding surface.

2. The beater mill as claimed in claim 1, wherein the retaining rings not located in the operating position are held in a position of readiness on the inside of the mill housing, the retaining rings with the largest retaining rim height bearing against the housing wall.

3. The beater mill as claimed in claim 2, wherein said retaining rings are provided with control elements by means of which they can be adjusted in the axial direction and can be locked both in their operating position and in their position of readiness on webs provided outside the mill housing.

4. The beater mill as claimed in claim 1, wherein said beater rotor includes a beater hub having an axis, and wherein the retaining rings are constructed and arranged to be in planes parallel with said beater tools and perpendicular to the axis of said beater hub.

5. The beater mill as claimed in claim 1, further including rotor plates carrying said beater tools, said rotor plates forming a guide duct which is shaped like an annular disk which opens out peripherally onto the axial center of the grinding surface.

* * * * *